United States Patent [19]

Conway

[11] 4,258,609

[45] Mar. 31, 1981

[54] DUAL SPEED HYDRAULIC PISTON ASSEMBLY

[76] Inventor: John P. Conway, 172 Carriage La., Columbia, S.C. 29210

[21] Appl. No.: 841,217

[22] Filed: Oct. 11, 1977

[51] Int. Cl.[3] ..... F15B 15/17; F15B 13/042

[52] U.S. Cl. ..... 91/416; 91/422; 91/468; 92/110

[58] Field of Search ..... 91/416, 422

[56] References Cited

U.S. PATENT DOCUMENTS

| | | | |
|---|---|---|---|
| 487,132 | 11/1892 | Smith | 91/422 |
| 523,419 | 7/1894 | Thorpe . | |
| 2,283,124 | 5/1942 | Peterson et al. . | |
| 2,335,917 | 12/1943 | Cuthbert . | |
| 2,735,502 | 2/1956 | Muller . | |
| 2,875,732 | 3/1959 | Hoffman . | |
| 2,935,852 | 5/1960 | Russell . | |
| 2,986,123 | 5/1961 | Augustin . | |
| 2,991,130 | 7/1961 | Sampietro . | |
| 3,059,433 | 10/1962 | Hirsch . | |
| 3,390,616 | 7/1968 | Hammer . | |
| 3,447,424 | 6/1969 | Billings . | |
| 3,476,016 | 11/1969 | Dixon et al. . | |
| 3,554,087 | 1/1971 | Florganic et al. | 91/416 |
| 3,734,464 | 5/1973 | Bushnell, Jr. . | |
| 3,789,737 | 2/1974 | Burnett | 91/416 |
| 3,817,152 | 6/1974 | Viron . | |
| 3,818,801 | 6/1974 | Kime . | |
| 3,824,897 | 7/1974 | Bryntse et al. . | |
| 3,832,937 | 9/1974 | Moore . | |
| 3,971,216 | 7/1976 | Miller . | |

FOREIGN PATENT DOCUMENTS 2412916 3/1973 Fed. Rep. of Germany .

*Primary Examiner*—Paul E. Maslousky
*Attorney, Agent, or Firm*—Benjamin G. Weil

[57] ABSTRACT

Liquid fluid pressure applied to a piston causes advancement thereof at a rapid rate until an external resisting load applied to the piston rod exceeds a predetermined value producing a corresponding increase in the pressure within the opposing pressure chambers to which the piston is exposed. Bi-directional flow, conducted between the opposing chambers during rapid piston movement, is automatically blocked by a differential circuit pressure operated piston valve to cause a rapid increase in the differential pressures acting on the piston, and an increase in the value of the external piston rod load with a corresponding decrease in its rate of movement in the same direction. A modified embodiment permits the piston rod to act under pressure and with a force in both the extending and retracting phases of the stroke with the same rapid extending rate until the external resisting force is encountered.

7 Claims, 16 Drawing Figures

DUAL SPEED HYDRAULIC PISTON ASSEMBLY

BACKGROUND OF THE INVENTION

This invention relates to a fluid power piston device of the. differential circuit pressure operated type which exerts an extending force at a rapid or slower rate, depending upon applied load.

Hydraulic or fluid operated piston devices are commonly used to convert fluid energy into mechanical energy in many industrial applications such as clamping, press and die stamping operations. In many such applications, a relatively low resisting load is initially applied to the piston through its piston rod during the power stroke so that the pressurized fluid conducted to the cylinder housing is supplied at a constant rate with low inlet pressure to produce uniform travel of the piston until it encounters a higher resisting load near the end of the power stroke. At that point, the piston continues its travel to the end of the power stroke at the same rate under an increased inlet pressure of the fluid supplied at the same inflow rate. Accordingly, the piston device and its fluid supply system must be designed to meet maximum load conditions regardless of the relative intervals of time during which maximum load is applied to the piston. A considerable waste of fluid and energy is therefore involved.

In order to meet different load conditions, various complex arrangements have been devised, often applied to the fluid supply system to vary the inlet pressure and inflow rate of fluid to the cylinder housing enclosing the piston. Controls have also been devised to change the operational mode of the piston device by conducting uni-directional external by-pass flow passages between opposing pressure chambers of the cylinder. Complex modifications of the piston and cylinder structure have also been proposed creating a plurality of additional pressure chambers and piston pressure faces to modify the operational mode of the piston device.

It is therefore an important object of the present invention to provide a fluid operated piston device that will automatically change its operational mode to meet an increase in loading during travel in one direction, with a less complex modification of the piston and cylinder structure as compared to prior art arrangements and without complex controls in the fluid supply system associated therewith and which permits positioning of the piston device by an external force with a minimum of fluid resistance.

A further object is to provide a modified piston device which is retractable by a reversed pressurized fluid flow to permit exertion of a force in the opposite direction.

PRIOR ART STATEMENT

A prior art statement has been separately filed pursuant to rules 1.97 and 1.99, and in conformance with rule 1.98. U.S. Pat. No. 3,817,152 appears to be most pertinent in that it features a single acting, differential pressure operated piston associated with a fluid control system through which a load responsive change in operational mode may be effected involving by-pass flow between opposing pressure chambers, an auxiliary piston control surface subjected to external control pressure and controls for supply of pressurized fluid, exhaust of fluid and by-pass valve closing with respect to the opposing pressure chambers. The by-pass valve and flow passage is disposed external to the cylinder pressure chamber.

SUMMARY OF THE INVENTION

In accordance with the present invention, a piston device is displaced through a power stroke by fluid under pressure supplied to only one of two opposing pressure chambers into which the cylinder housing is divided by the piston. A piston rod extends from the piston through the other pressure chamber which is contracted during the power stroke. Bi-directional by-pass flow passages formed in the piston equalize the pressures in the opposing chambers by transfer of fluid therebetween at a rate substantially higher than the inflow rate of fluid from the fluid supply system resulting in relatively rapid travel of the piston until it experiences an increase in the resisting load applied externally to the piston rod. The resulting rise in the pressure of the fluid within the opposing pressure chambers causes closing of a pressure operated piston valve to block flow through the by-pass passages and thus automatically change the operational mode of the piston device during its travel in one direction toward the end of the power stroke. The piston thus continues travel at a lower speed against the higher resisting load as the inlet pressure chamber continues to expand. A relief valve opens under the urge of the higher pressure to permit exhaust of fluid from the opposing contracting pressure chamber.

The piston valve is continuously biased to its open position by a spring acting on a valve stem slidably received within a cavity formed in the piston rod. The spring cavity in one embodiment is vented to atmosphere by a vent passage formed in the piston rod. Alternatively, the vent passage may be selectively connected to a source of pressurized control fluid to lock the piston valve in the open position while permitting selective closing thereof.

As used herein, the term 'fluid' and its derivatives is employed to denote a liquid

BRIEF DESCRIPTION OF DRAWING FIGURES

DETAILED DESCRIPTION OF PREFERRED EMBODIMENTS

Figure 1:
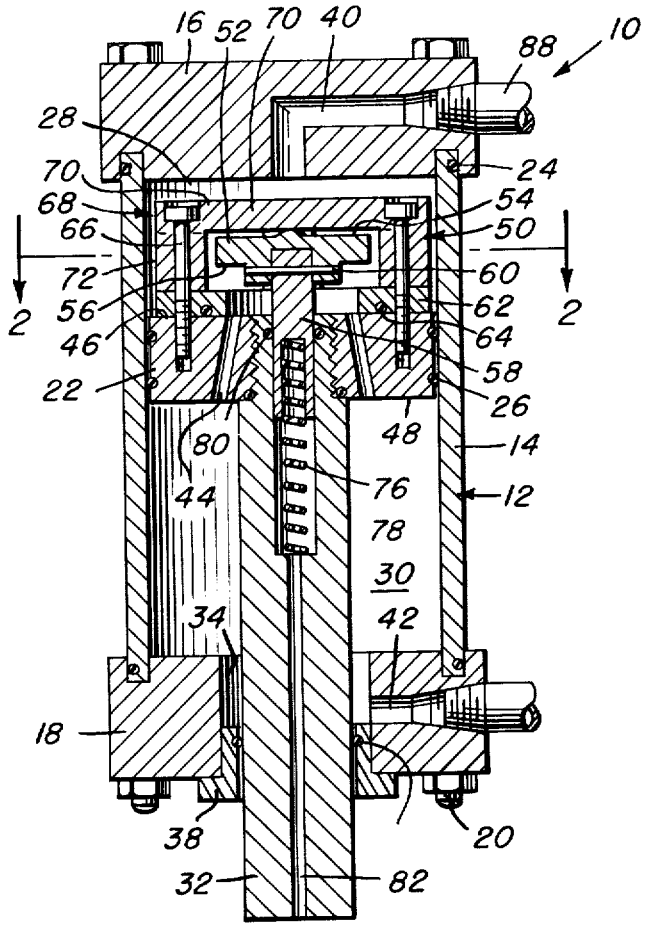
FIG. 1 is a longitudinal section view through a hydraulic piston device constructed in accordance with the present invention.

Referring now to the drawings in detail, FIG. 1 illustrates a fluid power-operated piston device generally referred to by reference numeral 10. The piston device 10 is similar to prior art arrangements in that it includes a pressure sealed cylinder housing generally referred to by reference numeral 12, including an elongated cylindrical wall portion 14 connected at one axial end to end wall block 16 and at the other axial end to end wall block 18. Elongated bolt assemblies 20 hold the end wall blocks and cylindrical wall portion 14 assembled to form a pressure sealed cylindrical chamber within which piston 22 is slidably displaced between the end wall blocks 16 and 18. Static seals 24 prevent leakage of pressurized fluid from the internal cylinder chamber while annular piston rings 26 on the piston wipingly engage the inner cylindrical surface of the wall portion 14 in order to sealingly divide the housing into opposing pressure chambers 28 and 30. A piston rod 32 is threadedly connected to the piston 22 and extends therefrom through the pressure chamber 30 and a central opening 34 in the end wall block 18 to engage an external load. A slide bearing 38 is received within the opening 34 and provided with a seal 38 for wiping engagement with the piston rod 32 projecting from the cylinder housing 12. An inlet passage 40 is formed in the end wall block 16 for supply of pressurized fluid to only one of the opposing pressure chambers 28 and alternatively, to permit exhaust of fluid therefrom. An outlet passage 42, on the other hand, is formed in the end wall block 18 communicating with the central opening 34 in order to accommodate outflow of fluid from the pressure chamber 30.

In accordance with the present invention, several bi-directional flow passages 44 are formed in the piston 22 and may extend in diverging relationship to each other from one face 46 of the piston exposed to chamber 28 to the other face 48 of the piston exposed to chamber 30. The passages 44 will accordingly freely conduct by-pass flow of fluid between the opposing chambers 28 and 30 in one operational mode of the piston device characterized by relatively rapid travel of the piston during its power stroke.

Figure 2:
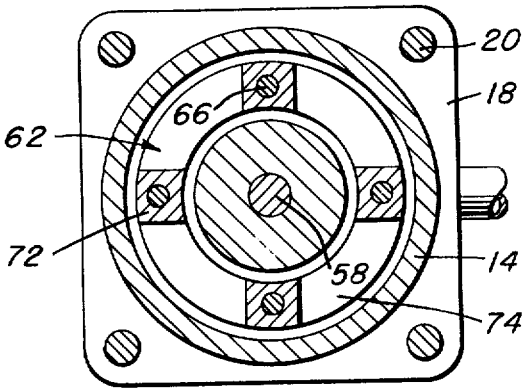
FIG. 2 is a transverse section view taken substantially through a plane indicated by section line 2—2 in FIG. 1.

Mounted on the piston 22 within the inlet pressure chamber 28 is a piston valve assembly generally referred to by reference numeral 50 through which are the by-pass flow passages 44 that are automatically blocked in order to change the operational mode of the piston device characterized by relatively slow speed travel of the piston as it approaches the end of its power stroke under a relatively high resisting load. The valve assembly 50 includes a circular valve disc 52 having a pressure face 54 on one axial side thereof and a parallel pressure face 56 on the other axial side from which a valve stem 58 extends. The valve stem 58 is connected by means of a pin 60 to the valve disc 52. It will be apparent that the effective area of the valve face 54 is larger than that of the valve face 56, in view of the space occupied by the valve stem 58 so as to produce a force differential on the valve disc 52 tending to displace the valve disc toward the piston into engagement with an annular valve seat element 62 positioned on the piston face 46 in sealing relation to the by-pass flow passages 44 because of the annular seal 64. The valve seat element 62 is held assembled on the piston by means of a plurality of fastener bolts 66 that extend from a retainer cap 68 through the valve seat into threaded engagement with the piston. The retainer cap 68 includes a stop disc portion 70 from which a plurality of spacing legs 72 extend into engagement with the valve seat element 62. The assembly bolts 66 extend through the spacing legs 72. Passages 74 are accordingly formed between the spacing legs 72 as more clearly seen in FIG. 2 through which free fluid communication is established between the by-pass passages 44 and the inlet pressure chamber 28 while the valve assembly 50 is in its open position with pressure face 54 abutting the stop disc portion 70 of the retainer cap, as shown in FIG. 1.

The valve disc 52 is biased to its open position by means of a compression spring 76 housed within a cylindrical cavity 78 formed in the piston rod 32. The cavity 78 slidingly receives the valve stem 58 which is in wiping engagement with the moving seal 80 carried by the threaded end portion of the piston rod. The spring cavity 78 is vented to atmosphere in the embodiment illustrated in FIG. 1 through a vent passage bore 82 extending longitudinally through the piston rod from the cavity 78.

The vent to the atmosphere, or its equivalent hereinafter described, is an essential feature of my invention. A constant pressure, namely atmospheric pressure, is applied against the valve stem 58 by reason of spring cavity 78 being vented to the atmosphere. This provides a constant reference base against which all trigger signals controlling the dynamic actions of my components are biased, including a reference base for the foregoing bias. Without the reference base pressure provided by the vent, consistent sequential operation of my device as herein described will not take place.

Figure 3:
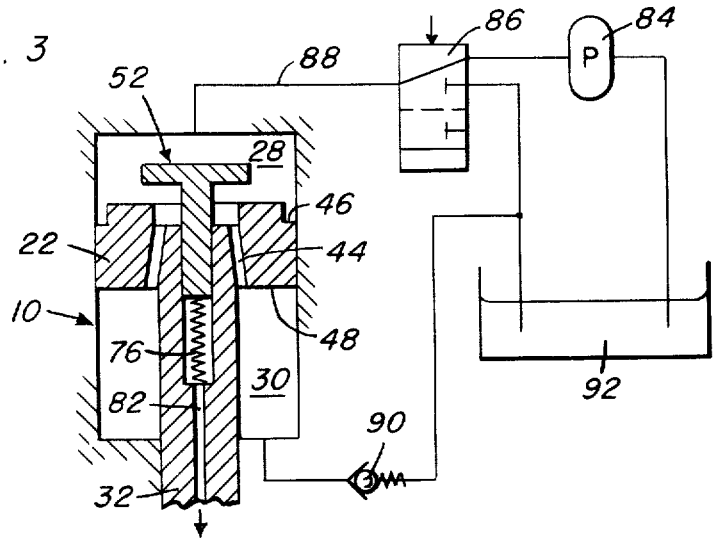
FIG. 3 is a schematic illustration of the piston device shown in FIG. 1 together with its associated fluid supply system.
Figure 4:
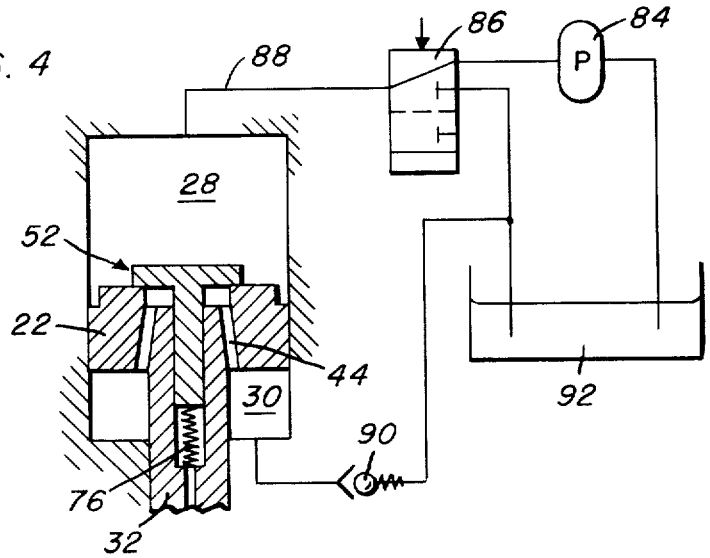
FIG. 4 is a schematic illustration similar to that of FIG. 3, but showing the piston device in another operational mode.

As shown in FIG. 3, fluid under pressure from a suitable pressure source such as pump 84 is conducted through a three-port selector valve 86 to the inlet pressure chamber 28 at the beginning of a power stroke. The valve disc 52 being held in its open position under the bias of spring 76 permits bi-directional flow through passages 44 so that both opposing pressure chambers 28 and 30 will be pressurized at substantially equal pressures causing travel of the piston under a differential force inasmuch as the area of piston face 46 is larger than the area of piston face 48. The piston travels at a relatively high speed in view of the transfer of fluid through passages 44 between the opposing pressure chambers at a rate substantially higher than that of the inflow rate of fluid into inlet pressure chamber 28 through supply conduit 88 from the selector valve 86. Rapid travel of the piston through its power stroke continues until the piston rod 32 meets a relatively higher resisting load during the power stroke. The pressure of the fluid in chambers 28 and 30 accordingly increases to a point at which the differential closing force on the valve, resulting from the fluid pressure acting on the different areas of valve disc 52, overcomes the bias of spring 76 causing the valve disc to close, as shown in FIG. 4. The by-pass passages 44 will then be blocked so that travel of the piston 22 continues under a different operational mode at a lower rate of speed. Piston travel is slower because chamber 28 continues to expand at a rate determined by the low inflow rate of fluid from supply conduit 88 as fluid from the contracting chamber 30 is exhausted to vented sump 92 through a relief valve 90 that is opened in response to the higher pressure attained when the change in operational mode occurs.

Figure 8:
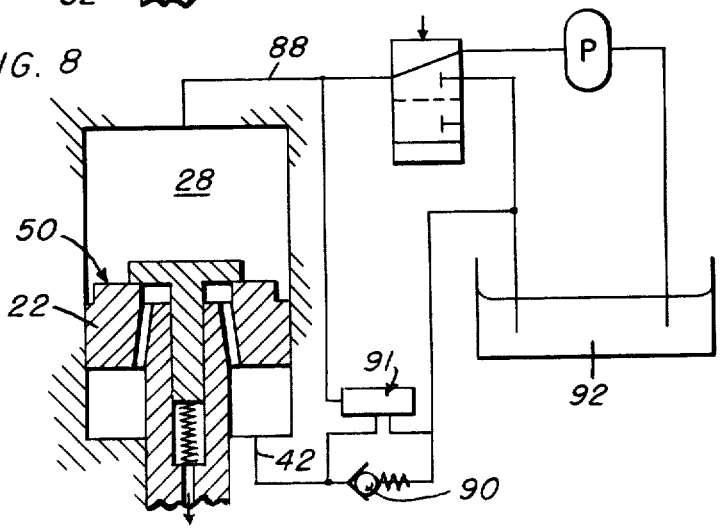
FIG. 8 is a schematic illustration similar to that of FIG. 3, but showing the piston device with a further modified fluid supply system and controls.
Figure 10:
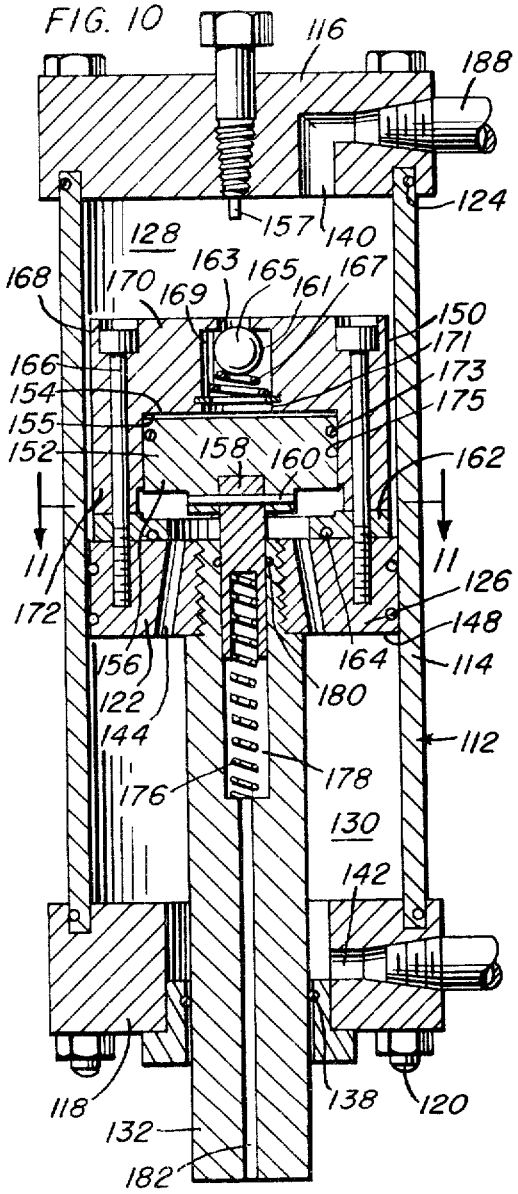
FIG. 10 is a longitudinal section view through a double acting hydraulic piston device constructed in accordance with the present invention.
Figure 12:
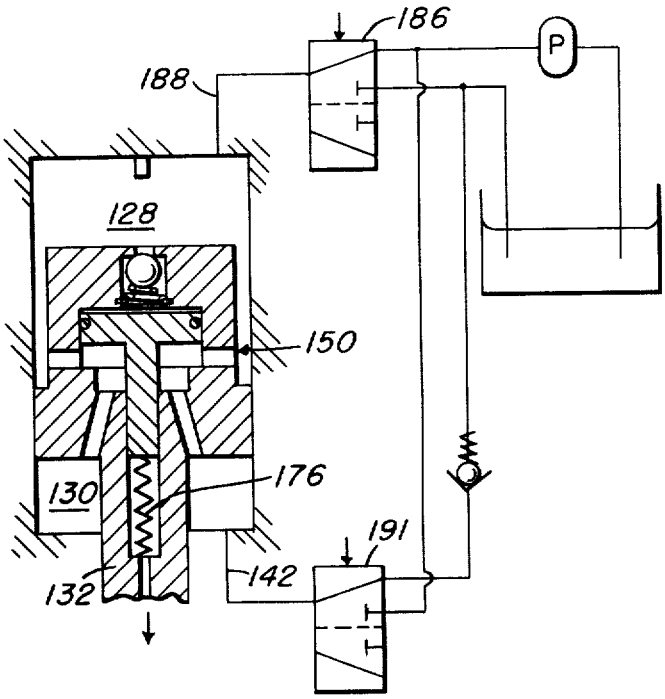
FIG. 12 is a schematic illustration of the double acting piston device shown in FIG. 10 together with an associated fluid supply system.
Figure 8A:
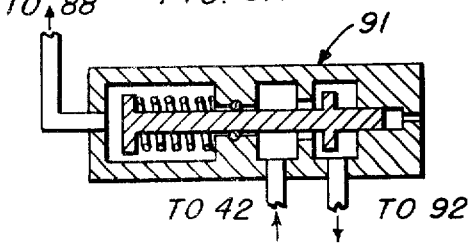
FIG. 8A is an enlarged sectional view of a detail of the valve illustrated in FIG. 8.
Figure 13:
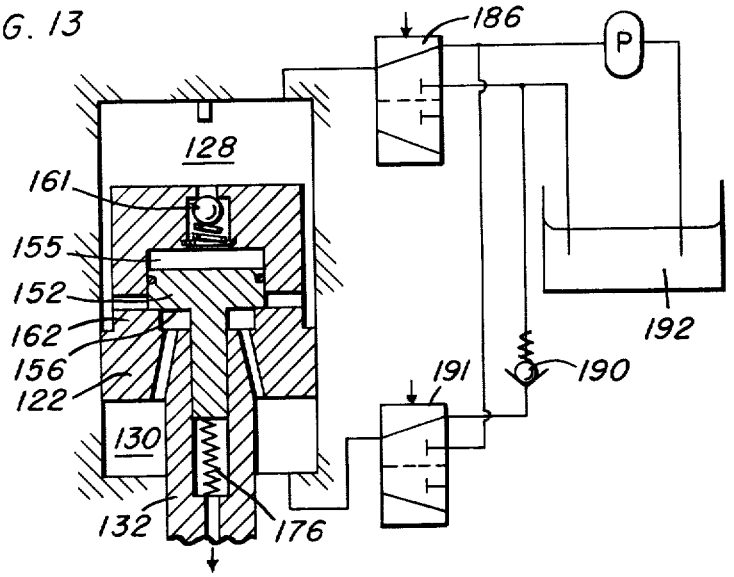
FIG. 13 is a schematic illustration similar to that of FIG. 12, but showing the double acting piston device in another operational mode.
Figure 14:
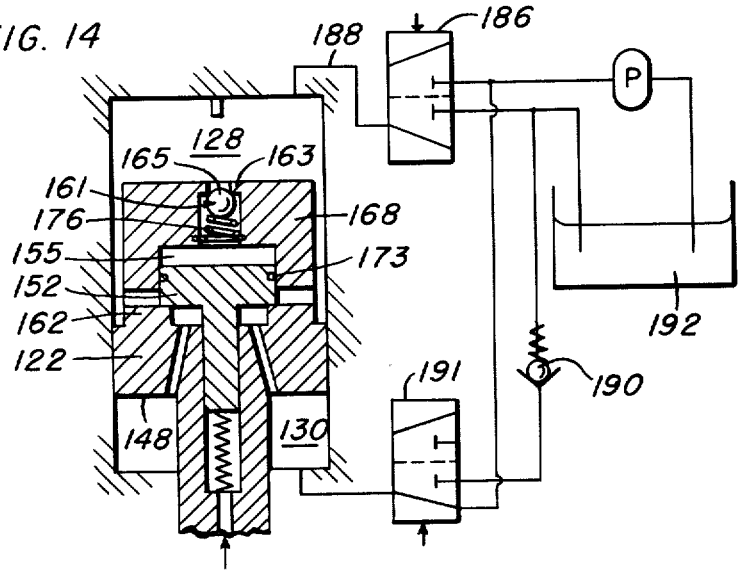
FIG. 14 is a schematic illustration similar to that of FIG. 12, but showing the double acting piston device in a further operational mode.
Figure 15:
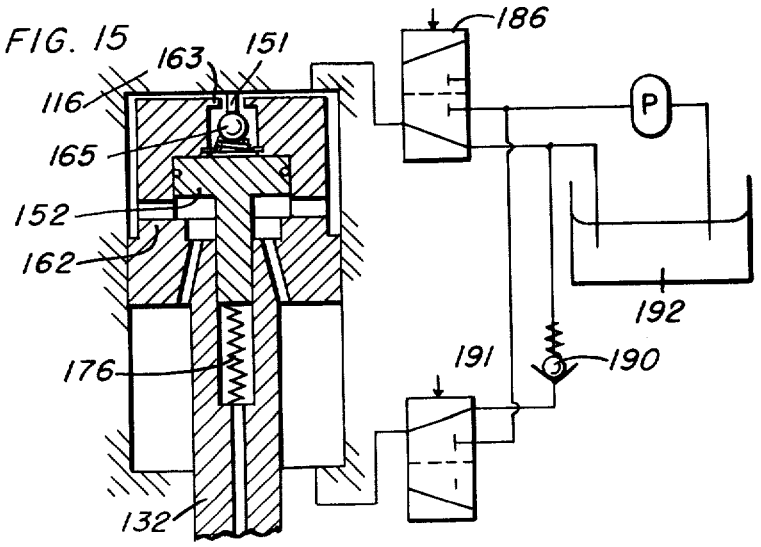
FIG. 15 is a schematic illustration similar to that of FIG. 12 in yet another operational mode.

It is to be understood that if provision is made, by any known mechanism or signal device, to insure complete opening of relief valve 90 when piston rod 32 encounters maximum load and maximum pressure exists in chamber 28, the maximum force is exerted against the load. FIG. 8 illustrates this system by utilizing a two position, two way valve 91 which can by-pass relief valve 90. Valve 91 is controlled by a pilot pressure signal obtained from cylinder supply line 88. Valve 91 is fully illustrated in FIG. 8*a*, so that its construction and operation is readily apparent to one skilled in the art.

Figure 5:
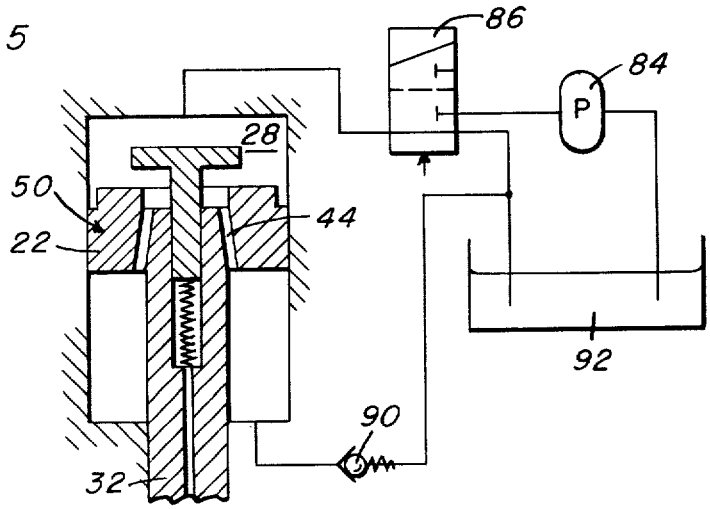
FIG. 5 is a schematic illustration similar to that of FIG. 3, but showing the device in a further operational mode.

When the selector valve 86, as shown in FIG. 5, is displaced to its other operative position, inlet pressure chamber 28 will then be connected to sump 92 and valve assembly 50 will be opened. The piston 22 may then be easily displaced in either direction by an external force applied to the piston rod.

Figure 6:
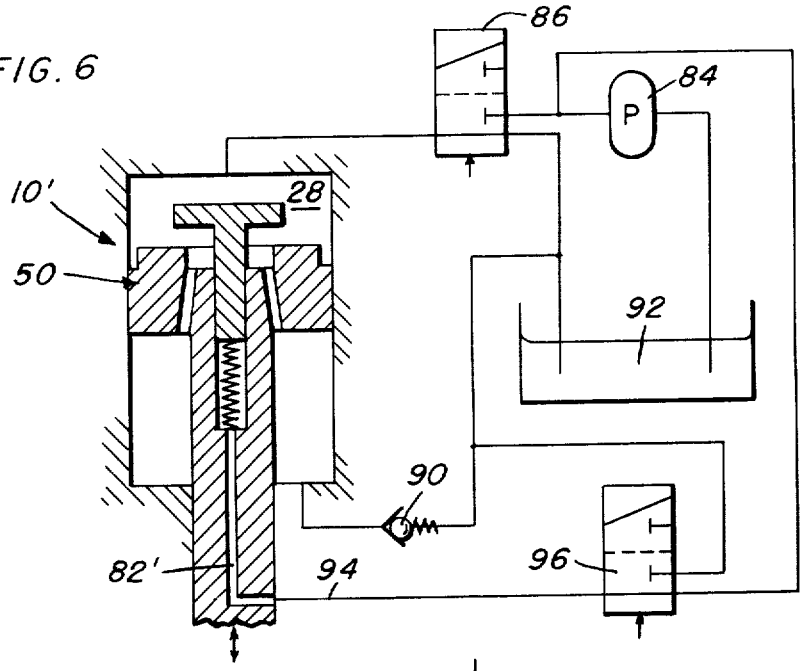
FIG. 6 is a schematic illustration of the piston device and a modified fluid supply system and controls.

FIG. 6 illustrates a modified form of piston device generally referred to by reference numeral 10' with which a similar fluid supply system is associated including the pump 84, sump 92, selector valve 86, and relief valve 90, as hereinbefore described with respect to FIGS. 3, 4 and 5. The piston device itself is also similar to the piston device 10 hereinbefore described except that the vent passage 82' is connected through a flexible conduit 94 to the outlet port of an overruling valve 96 having two inlet ports respectively connected to the pump outlet and sump 92. In one position of the valve 96, the vent passage 82' will be connected to sump 92 and will therefore function in the same manner as hereinbefore indicated with respect to vent passage 82. However, when the valve 96 is displaced to the overrule position shown in FIG. 6, pressurized control fluid from pump 84 will be supplied to the spring cavity through the vent passage 82' and thereby hold or lock the piston valve 50 in its open position as shown. The piston valve will therefore remain open despite any closing forces ordinarily caused by a rise in pressure in inlet chamber 28. The valve 96 may either be displaced manually or by some external signal to its other operative position to permit closing of the piston valve or automatically displaced to its other operative position by some piston position responsive mechanism.

Figure 7:
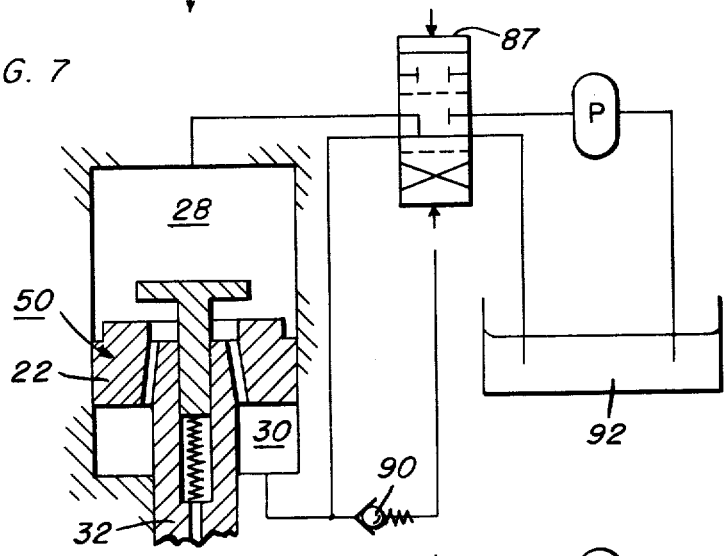
FIG. 7 is a schematic illustration similar to that of FIG. 3, but showing the piston device with yet another modification of the control and fluid supply system.

The embodiment of FIG. 3 could be further modified as shown in FIG. 7 by utilizing the four-way three-position control valve 87. This valve will permit similar cylinder action as shown in FIGS. 3, 4 and 5, but have the added feature of being able to rapidly open the piston valve 50 at the completion of its power stroke, especially when the piston rod 32 is opposed by a spring type resilient load which is attempting to displace the piston rod and piston 22 backwards. In FIGS. 3, 4 and 5, fluid cannot enter chamber 30 immediately following the power stroke since relief valve 90 is uni-directional away from chamber 30 and piston valve 50 is held closed due to the partial vacuum in chamber 30 caused by the above-mentioned resilient load applied to piston rod 32. Under similar circumstances, the embodiment in FIG. 7 can break this vacuum in chamber 30 by momentarily shifting control valve 87, thus connecting fluid pressure to chamber 30 and venting chamber 28 to the sump 92. This momentary flow of fluid would force open piston valve 50 and permit the embodiment to enter the free motion mode when control valve 87 is shifted to its center position.

Figure 9:
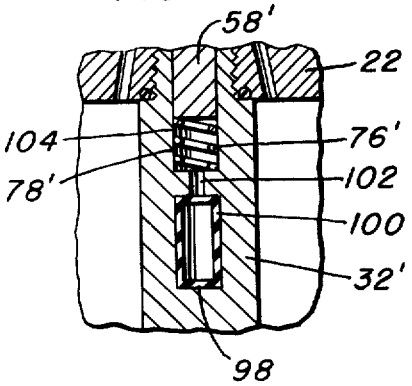
FIG. 9 is a partial section view showing a modification of the piston device shown in FIG. 1.

FIG. 9 illustrates a modified embodiment of the invention which eliminates the vent passage 82 through the piston rod 32. FIG. 9 shows piston 22 connected to a piston rod 32' modified so as to have a chamber 98 formed therein housing a flexible gas filled container 100 having at least one closed cell. Any compressible gas at atmospheric pressure is suitable. Chamber 98 is in fluid communication through vent passage 102 with spring cavity 104 within which compression spring 76' is enclosed exerting a continuous bias force on valve stem 58', thus holding valve 50 open. The flexible container 100 filled with gas at atmospheric pressure permits the operation of piston valve 50 by compressing to a reduced volume when valve stem 58' is forced into cavity 104 with the closing of piston valve 50. This flexible gas filled container 100 eliminates the eventual filling of chamber 98 with non-compressible fluid which would impair the operation of valve assembly 50. The closed cell gas filled container 100 associated with the modification in FIG. 9 performs the same as hereinbefore described with respect to FIGS. 3, 4, 5, 7, and 8 where spring chamber 78 is vented to true atmosphere by means of vent passage 82 to provide a reference pressure.

FIGS. 10 through 15 show a modified type piston valve 150 which is similar to the valve device 50, but permits a piston to operate with a force in two directions, and therefore is considered a double acting piston. Piston 122 is constructed similarly to piston 22 and has ports 144 together with surface 148 in juxtaposition to chamber 130. Piston 122 has valve seat element 162 mounted thereon together with a retainer cap 168. Valve disc 152 has pressure faces 154 and 156 adjacent to valve chambers 155 and 153 respectively.

Figure 11:
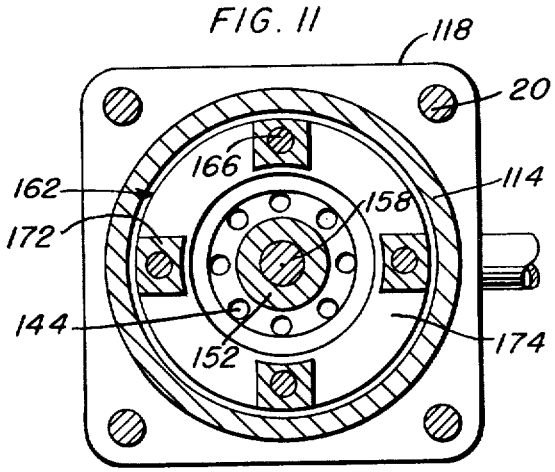
FIG. 11 is a transverse sectional view taken substantially through a plane indicated by section line 11—11 in FIG. 10.

Retainer cap 168 is constructed similar to retainer cap 68 including a stop disc portion 170 from which a plurality of spacing legs 172 extend into engagement with valve seat 162 and providing passages 174 between the spacing legs 172, as more clearly seen in FIG. 11, to provide free fluid communication between chamber 130 and the inlet pressure chamber 128 when valve assembly 150 is in its open position. However, a check valve 161 and ring seal 173 are added.

Valve disc 152 is slightly modified in that it has a sealing communication with inner faces 175 of retainer cap 168. Ring seals 173 are located in wall 175 to insure sealing engagement between valve disc 152 and retainer 168. As more clearly seen in FIG. 13, when valve disc 152 is in the position for extending piston rod 132, there is sealing engagement between face 156 and valve seat element 162 to thereby prevent any flow of fluid between chambers 128 and 130.

Retainer cap 168 includes the addition of a valve 161 which may be of the ball seat or the spool type. The valve 161 is mounted in retainer cap 168 having port and valve seat 163 in the portion thereof adjacent to chamber 128. Ball valve member 165 is held against port seat 163 by a low force spring 167 mounted within chamber 169. Chamber 169 communicates with valve chamber 155 through port 171. Check valve 161 permits only uni-directional flow from chamber 128 to chamber 155 unless it is displaced by boss 157.

The double acting modification of FIGS. 10-15 operates similarly to the single acting configuration in that the fluid supply consists of a fluid sump and pump and the basic control circuit consists of two three-way, two-position fluid valves and a pressure relief valve.

The rapid extension mode must begin with piston valve assembly 150 open to permit flow from chamber 130 to chamber 128. Supply of pressurized fluid to chamber 128 through port 188 by three-way valve 186 initiates the rapid extension mode. The three-way valve 191 connects port 142 to the pressure relief valve 190, as seen primarily in FIGS. 12 through 15. In this position, the piston rod 132 is extending in the rapid extension mode with fluid flowing unrestrictedly from chamber 130 to chamber 128. This action with continue until piston rod 132 encounters an increased resistive force such that spring 176 is overpowered, thereby permitting valve disc 152 to seat against valve seat 162 and stop any fluid flow through piston 122. The unbalanced force caused by the fluid pressure acting upon unequal surface areas of the top and bottom of the valve disc 152 causes valve disc 152 to close by overcoming of the spring 176. The increase of pressure in chambers 128 and 130 is also effected in chamber 155 on the upper portion of valve disc 152 since valve 161 permits essentially free flow from chamber 128 to chamber 155. Since the fluid flow from chamber 128 to chamber 155 is essentially unrestricted, the operation of this modification is identical in this respect to the operation of the single acting embodiment in the rapid extension mode and the power extension mode.

The piston rod retraction mode of operation commences when both control valves 186 and 191 are shifted in position such that fluid is supplied under pressure to chamber 130 and leaves chamber 128 through port 188 to flow to sump 192. The flow from chamber 128 to sump 192 occurs because no flow is permitted through piston 122 because fluid trapped in chamber 155 locks the valve disc 152 sealingly tight against valve seat 162. The fluid is trapped in chamber 155 because of annular seal 173 between retainer cap 168 and valve disc 152, as well as the sealing of valve 161 to prevent fluid flow from chamber 155 to chamber 128. This is accomplished because the pressure in chamber 155 together with the force exerted by spring 176 forces ball 165 against seat and port 163. The force which piston 132 can apply to the retraction external load equals the fluid pressure in chamber 130 acting upon the piston surface 148.

The termination of the retraction mode by fluid power is accomplished when piston 122 reaches the back end of its stroke and control valve 191 has been shifted, thereby preventing all fluid under pressure from being supplied to the cylinder. The boss 151 extending from the end block 116 displaces ball valve 165 from seat 163, thereby permitting fluid to flow between chamber 155 and chamber 128. Valve 161 is held open permitting the fluid trapped in chamber 155 to escape through port 163 to chamber 128 as spring 176 pushes the disc valve 152 away from its valve seat 162 and reduces the size of chamber 155. The fluid in chamber 128 is permitted to flow to the sump 192 by control valve 186. At this point in the operation, the piston valve assembly 150 is open and the cylinder is in the free motion mode, that is, it is free to be moved in either direction by an external force applied to the piston rod 132. Valve 186 is then shifted changing to the rapid extension mode by connecting chamber 128 to supply pressure while valve 191 is already in the position connecting chamber 130 through relief valve 190 to sump 192.

In summary, it is seen that the embodiment shown in FIGS. 10 through 15 permits the piston device to move forward rapidly, extending piston rod 132 until sufficient load is encountered to overcome spring 176, at which time valve disc 152 is forced against valve seat element 162 blocking the fluid flow through piston 122 and causing the piston rod 132 to extend in the high pressure mode of operation. This action enlarges chamber 155 which is filled with fluid entering through unidirectional valve 161. This fluid is trapped in chamber 155 by valve 161, thus locking valve disc 152 against valve seat 162 and closing piston valve 150. In this state, no fluid is permitted through piston 122 between chambers 128 and 130 regardless of pressure differences between these chambers. Shifting valves 186 and 191 by any electrical or mechanical means to the reverse position permits fluid under pressure to enter chamber 130 while fluid in chamber 128 is exhausted to the sump 192, thus putting the cylinder in the retracting mode.

This construction permits piston rod 132 to act under pressure in the retracting direction as well as extending under pressure in two speeds depending on the external resistance force.

What is claimed is:

1. In combination with a liquid fluid piston device having a pressure housing, a piston dividing the housing into opposing pressure chambers, a piston rod extending from said piston through one of said chambers, a source of pressurized fluid, means for permitting flow of pressurized fluid into and out of each of said pressure chambers, and first valve means for selectively conducting said fluid to the other of said opposing chambers to effect displacement of said piston; automatic means for changing the rate of displacement of the piston during travel in one direction in response to a resisting load increased above a predetermined value applied externally to said piston rod, comprising:

first passage means in the piston for conducting flow of fluid through said piston between said opposing chambers during relatively rapid travel of said piston under a resisting load less than said predetermined value, second valve means in said other chamber actuated by changes in fluid pressure within said other chamber in response to said increased load and movable in response to said changes in pressure toward a closed position to restrict said flow between said chambers, said second valve means being movable towards said closed position solely by fluid pressure, second passage means channeled in said piston rod and fluidly connecting a constant reference pressure to said second valve means independent of pressures within said chambers, spring means for holding said second valve means in an open position until overcome by the fluid pressure in said other chamber when the resisting load exceeds said predetermined value, and relief valve means connected to the chamber through which the piston rod extends for unloading pressurized fluid from said chamber during relatively slow travel of said piston under a resisting load exceeding said predetermined value.

2. In combination with a liquid fluid piston device having a pressure housing, a piston dividing the housing into opposing pressure chambers, a piston rod extending from said piston through one of said chambers, a source of pressurized fluid, conduit means for permitting flow of pressurized fluid into and out of each of said pressure chambers, and first valve means for selectively conducting fluid to the other of said opposing chambers to effect displacement of said piston; automatic means for changing the rate of displacement of the piston during travel in one direction in response to a resisting load increased above a predetermined value applied externally to said piston rod, comprising:

first passage means in the piston for conducting flow of fluid through said piston between said opposing chambers during relatively rapid travel of said piston under a resisting load less than said predetermined value, second valve means in said other chamber actuated by changes in fluid pressure within said other chamber in response to said increased load and movable in response to said changes in pressure toward a closed position to block said flow between said chambers, said second valve means being movable toward said closed position solely by fluid pressure, second passage means channeled in said piston rod and fluidly connecting a constant reference pressure to said second valve means independent of pressures within said chambers by being unconnected to said means permitting flow of fluid in and out of said pressure chambers and sealed from fluid in said chamber, spring means for holding said second valve means in an open position until overcome by the fluid pressure in said other chamber when the resisting load exceeds said predetermined value, and relief valve means connected to the chamber through which the piston rod extends for unloading pressurized fluid from said chamber during relatively slow travel of said piston under a resisting load exceeding said predetermined value.

3. The combination of claim 2 wherein said second valve means includes a movable valve disc having opposing pressure faces, a valve stem extending from one of said faces, guide means mounted in the piston rod for slidably carrying the valve stem, a valve seat mounted on the piston within the other of said chambers for engagement by one of the faces of the valve disc in the closed position and retainer means connected to the piston for limiting movement of the valve disc to the open position under the said holding action of said spring means.

4. The combination of claim 3 wherein said guide means includes a cavity formed in said piston rod within which the valve stem is sealingly received, said spring means being enclosed in said cavity and said second passage means being connected to said cavity.

5. The combination of claim 4 wherein said second passage means includes a vent extending through said piston rod connected with said constant reference pressure.

6. The combination of claim 5 wherein said constant reference pressure is an atmospheric reference pressure.

7. In combination with a liquid fluid piston device having a pressure housing, a piston dividing the housing into opposing pressure chambers, a piston rod extending from said piston through one of said chambers, a source of pressurized fluid, and means for permitting flow of pressurized fluid into and out of each said pressure chambers, and first valve means for selectively conducting fluid to the other of said opposing chambers to effect displacement of said piston; automatic means for changing the rate of displacement of the piston during travel in one direction in response to a resisting load increased above a predetermined value applied externally to said piston rod, comprising:

first passage means in the piston for conducting flow of fluid through said piston between said opposing chambers during relatively rapid travel of said piston under a resisting load less than said predetermined value;

second valve means in said other chamber actuated by changes in fluid pressure within said other chamber in response to said increased load and movable in response to said changes in pressure toward a closed position to restrict said flow between said chambers, said second valve means being movable towards said closed position solely by fluid pressure, said second valve means comprising (a) a movable valve disc having opposing pressure faces, (b) a valve stem extending from one of said faces, (c) guide means slidably carrying said valve stem comprising a cavity in said piston rod within which said valve stem is sealingly received;

second passage means channeled in said piston rod and fluidly connecting a constant reference pressure to said second valve means independent of pressures within said chambers;

spring means enclosed in said cavity for holding said second valve means in an open position until overcome by the fluid pressure in said other chamber when the resisting load exceeds said predetermined value;

retaining means for limiting the motion of said valve disc connected to said piston; and relief valve means connected to the chamber through which the piston rod extends for unloading pressurized fluid from said chamber during relatively slow travel of said piston under a resisting load exceeding said predetermined value.

* * * * *